US010438738B2

(12) United States Patent
Yoshida et al.

(10) Patent No.: US 10,438,738 B2
(45) Date of Patent: Oct. 8, 2019

(54) REACTOR HAVING TERMINAL BLOCK

(71) Applicant: FANUC CORPORATION, Minamitsuru-gun, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 16/031,050

(22) Filed: Jul. 10, 2018

(65) Prior Publication Data

US 2019/0027299 A1 Jan. 24, 2019

(30) Foreign Application Priority Data

Jul. 18, 2017 (JP) ..... 2017-139224

(51) Int. Cl.

| | |
|---|---|
| ***H01F 30/12*** | (2006.01) |
| ***H01F 27/29*** | (2006.01) |
| ***H01F 27/24*** | (2006.01) |
| ***H01F 27/34*** | (2006.01) |
| ***H01F 27/04*** | (2006.01) |
| ***H01F 27/245*** | (2006.01) |
| ***H01F 27/28*** | (2006.01) |
| ***H01F 37/00*** | (2006.01) |

(52) U.S. Cl.

CPC ..... *H01F 27/29* (2013.01); *H01F 27/04* (2013.01); *H01F 27/24* (2013.01); *H01F 27/245* (2013.01); *H01F 27/2828* (2013.01); *H01F 27/343* (2013.01); *H01F 37/00* (2013.01); *H01F 30/12* (2013.01)

(58) Field of Classification Search

CPC ..... H01F 30/12; H01F 3/12
USPC ..... 336/5, 192
See application file for complete search history.

(56) References Cited

U.S. PATENT DOCUMENTS 3,188,592 A * 6/1965 Kukla ..... H01F 27/40 174/DIG. 2
3,479,563 A * 11/1969 Roy ..... H01F 27/402 336/192
4,804,340 A * 2/1989 Hamer ..... H01R 9/24 336/192
6,185,811 B1 * 2/2001 Perry ..... H01F 27/22 29/602.1
7,768,370 B2 * 8/2010 Brown ..... H01F 27/027 336/200

(Continued)

FOREIGN PATENT DOCUMENTS

CN 204539040 U 8/2015
CN 208538669 U 2/2019

(Continued)

*Primary Examiner* — Ronald Hinson
(74) *Attorney, Agent, or Firm* — RatnerPrestia

(57) ABSTRACT

A reactor includes a terminal block having a plurality of terminals which is coupled to one end of a core body. A plurality of surge protection elements are connected to the plurality of terminals inside the terminal block. Input side extension portions and output side extension portions extending from coils are connected to the plurality of terminals of the terminal block, and a plurality of surge protection elements are connected to the input side extension portions and the output side extension portions, respectively.

5 Claims, 9 Drawing Sheets

(56) References Cited

U.S. PATENT DOCUMENTS

| | | | | |
|---|---|---|---|---|
| 2002/0014941 | A1* | 2/2002 | Yoshioka | H01F 27/266 336/184 |
| 2006/0279393 | A1* | 12/2006 | Shudarek | H01F 27/263 336/198 |
| 2008/0197961 | A1* | 8/2008 | Patel | H01F 21/12 336/170 |
| 2009/0243769 | A1* | 10/2009 | Takaya | H01H 50/045 335/127 |
| 2012/0106210 | A1 | 5/2012 | Xu et al. | |
| 2014/0292456 | A1* | 10/2014 | Suzuki | H01F 27/402 336/55 |
| 2019/0027299 | A1 | 1/2019 | Yoshida et al. | |

FOREIGN PATENT DOCUMENTS

| | | | |
|---|---|---|---|
| EP | 2448100 | A2 | 5/2012 |
| JP | 5362166 | A | 6/1978 |
| JP | 08148209 | A | 6/1996 |
| JP | 2000-077242 | A | 3/2000 |
| JP | 2005294130 | A | 10/2005 |
| JP | 2008-210998 | A | 9/2008 |
| JP | 2017059805 | A | 3/2017 |
| WO | 2010119324 | A2 | 10/2010 |

* cited by examiner

REACTOR HAVING TERMINAL BLOCK

CROSS-REFERENCE TO RELATED APPLICATION

This application is a new U.S. Patent Application that claims benefit of Japanese Patent Application No. 2017-139224, filed Jul. 18, 2017, the disclosure of this application is being incorporated herein by reference in its entirety for all purposes.

BACKGROUND OF THE INVENTION

1. Field of the Invention

The present invention relates to a reactor having a terminal block.

2. Description of Related Art

Reactors include a plurality of iron core coils, and each iron core coil includes an iron core and a coil wound onto the iron core. Predetermined gaps are formed between the plurality of iron cores. Refer to, for example, Japanese Unexamined Patent Publication (Kokai) No. 2000-77242 and Japanese Unexamined Patent Publication (Kokai) No. 2008-210998. Furthermore, there are also reactors in which a plurality of iron core coils are arranged inside an annular outer peripheral iron core.

SUMMARY OF THE INVENTION

Such reactors are connected to motor drive devices. In order to protect the motor drive device from surges, such as induced lightning, surge protection equipment may be arranged between the reactor and the power supply. However, there is a problem that space is required to install the surge protection equipment, and the task of mounting the surge protection equipment is complicated.

Thus, a reactor including a terminal block having a surge protection function in a minimal space is desired.

According to the first aspect, there is provided a reactor, comprising a core body, the core body comprising an outer peripheral iron core, at least three iron cores which are arranged so as to contact or so as to be coupled with the inside of the outer peripheral iron core, and coils wound onto the iron cores, wherein gaps which can be magnetically coupled, are formed between one of the at least three iron cores and another iron core adjacent thereto, the reactor further comprising a terminal block having a plurality of terminals and coupled to one end of the core body, and a plurality of surge protection elements which are connected to the plurality of terminals inside the terminal block, wherein input side extension portions and output side extension portions extending from the coils are connected to the respective terminals of the terminal block, and the plurality of surge protection elements are connected to the input side extension portions and the output side extension portions, respectively.

In the first aspect, since the plurality of surge protection elements are arranged inside the terminal block, the reactor can have a surge protection function in a minimal space.

The object, features, and advantages of the present invention, as well as other objects, features and advantages, will be further clarified by the detailed description of the representative embodiments of the present invention shown in the accompanying drawings.

DETAILED DESCRIPTION

Figure 1A:
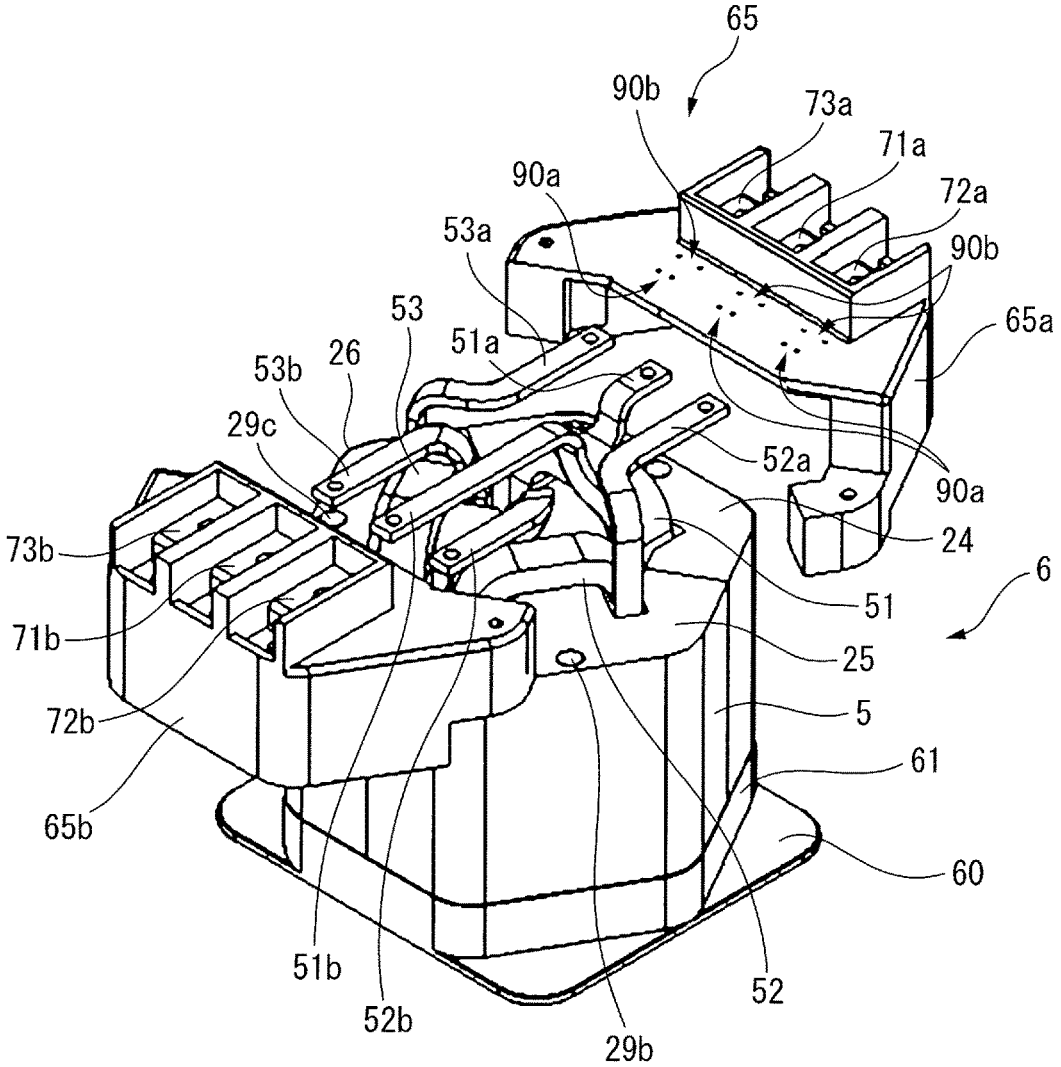
FIG. 1A is a partially exploded perspective view of a reactor according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will be described as an example. However, the present disclosure is not limited in application to a three-phase reactor but can be broadly applied to any multiphase reactor requiring constant inductance in each phase. Further, the reactor according to the present disclosure is not limited to those provided on the primary side or secondary side of the inverters of industrial robots or machine tools but can be applied to various machines.

Figure 1B:
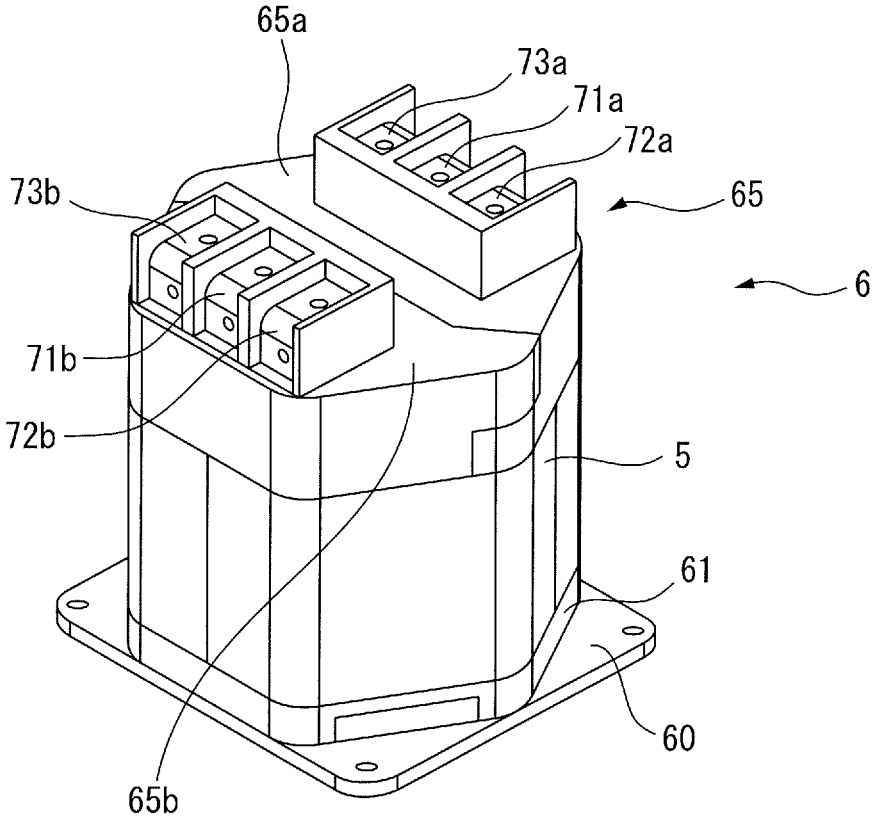
FIG. 1B is a perspective view of the reactor shown in FIG. 1A.

FIG. 1A is a partially-exploded perspective view of a reactor according to a first embodiment and FIG. 1B is a perspective view of the reactor shown in FIG. 1A. As shown in FIG. 1A and FIG. 1B, a reactor 6 mainly includes a core body 5, a pedestal 60 attached to one end of the core body 5, and a terminal block 65 attached to the other end of the core body 5. In other words, the ends of the core body 5 in the axial directions are interposed between the pedestal 60 and the terminal block 65.

An annular projection part 61 having an outer shape corresponding to the end face of the core body 5 is provided on the pedestal 60. The height of the projection part 61 is made slightly longer than the projecting height of the coils 51 to 53 projecting from the end of the core body 5.

The terminal block 65 includes a plurality of, for example, six, terminals 71*a* to 73*b*. The plurality of terminals 71*a* to 73*b* are respectively connected to a plurality of extension portions 51*a* to 53*b* (leads) extending from the coils 51 to 53. Furthermore, the terminal block 65 is composed of molded half portions 65*a*, 65*b*. The terminals 71*a* to 73*a* of the one molded half portion 65*a* are connected to the input side extension portions 51*a*, 52*a* and 53*a*, respectively. Likewise, the terminals 71*b* to 73*b* of the other molded half portion 65*b* are connected to the output side extension portions 51*b*, 52*b*, and 53*b*, respectively.

Figure 2:
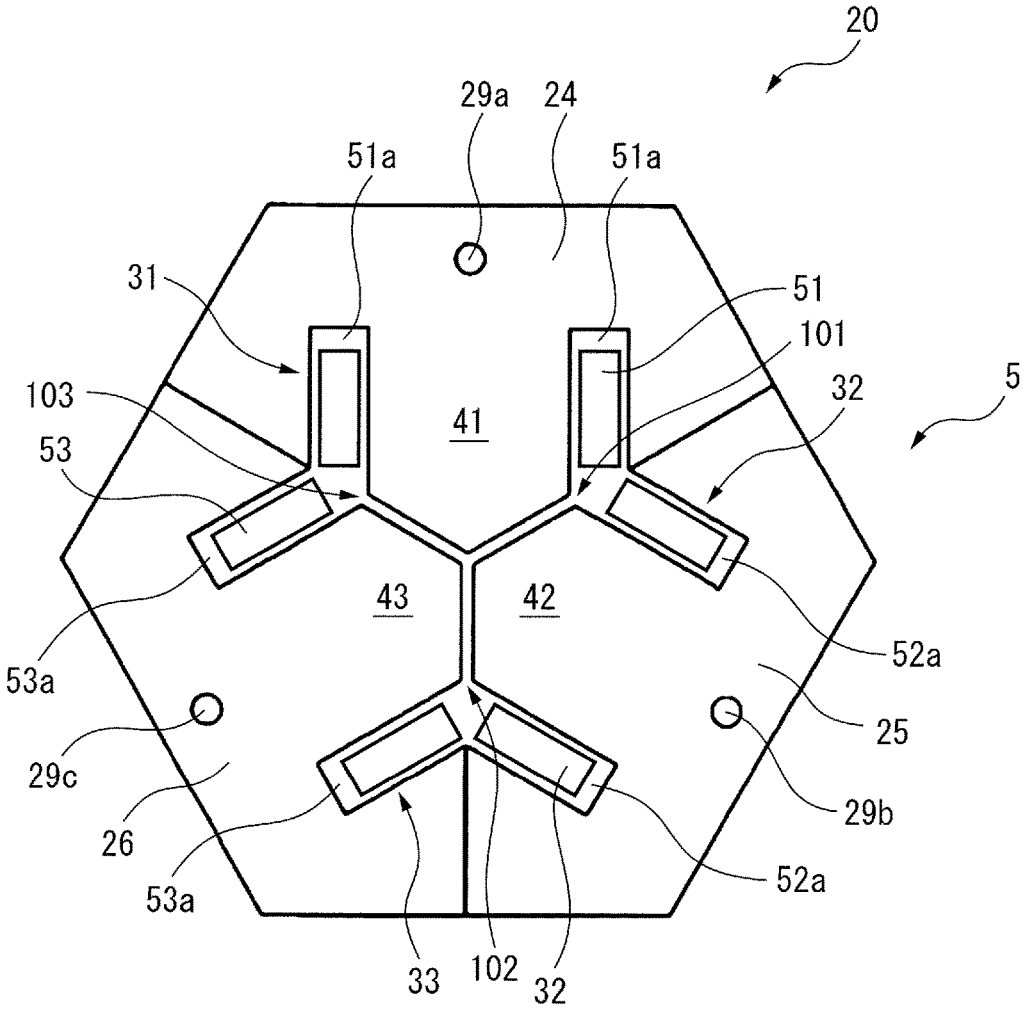
FIG. 2 is a cross-sectional view of the reactor shown in FIG. 1A.

FIG. 2 is a cross-sectional view of the core body of a reactor according to the first embodiment. As shown in FIG.

2, the core body 5 of the reactor 6 includes an annular outer peripheral iron core 20 and at least three iron core coils 31 to 33 arranged inside the outer peripheral iron core 20. In FIG. 2, the iron core coils 31 to 33 are arranged inside the substantially hexagonal outer peripheral iron core 20. The iron core coils 31 to 33 are arranged at equal intervals in the circumferential direction of the core body 5.

Note that the outer peripheral iron core 20 may have another rotationally-symmetrical shape, such as a circular shape. In such a case, the outer peripheral iron core 20 has a shape corresponding to the terminal block 65 and the pedestal 60. Furthermore, the number of the iron core coils may be a multiple of three, whereby the reactor 6 can be used as a three-phase reactor.

As can be understood from the drawing, the iron core coils 31 to 33 include iron cores 41 to 43 extending in the radial directions of the outer peripheral iron core 20 and coils 51 to 53 wound onto the iron cores 41 to 43, respectively.

The outer peripheral iron core 20 is composed of a plurality of, for example, three, outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are formed by stacking a plurality of iron plates, carbon steel plates, or electromagnetic steel sheets, or are formed from dust cores. When the outer peripheral iron core 20 is formed from a plurality of outer peripheral iron core portions 24 to 26, even if the outer peripheral iron core 20 is large, such an outer peripheral iron core 20 can be easily manufactured. Note that the number of iron cores 41 to 43 and the number of iron core portions 24 to 26 need not necessarily be the same. Furthermore, through-holes 29*a* to 29*c* are formed in the outer peripheral iron cores 24 to 29, which are used when the core body 5 is attached to the pedestal 60 and the terminal block 65.

Further, the radially inner ends of the iron cores 41 to 43 are each located near the center of the outer peripheral iron core 20. In the drawing, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, through which magnetic connection can be established.

In other words, the radially inner end of the iron core 41 is separated from the radially inner ends of the two adjacent iron cores 42 and 43 via gaps 101 and 103. The same is true for the other iron cores 42 and 43. Note that, the sizes of the gaps 101 to 103 are equal to each other.

In the configuration shown in FIG. 2, since a central iron core disposed at the center of the core body 5 is not needed, the core body 5 can be constructed lightly and simply. Further, since the three iron core coils 31 to 33 are surrounded by the outer peripheral iron core 20, the magnetic fields generated by the coils 51 to 53 do not leak to the outside of the outer peripheral core 20. Furthermore, since the gaps 101 to 103 can be provided at any thickness at a low cost, the configuration shown in FIG. 2 is advantageous in terms of design, as compared to conventionally configured reactors.

Further, in the core body 5 of the present disclosure, the difference in the magnetic path lengths is reduced between the phases, as compared to conventionally configured reactors. Thus, in the present disclosure, the imbalance in inductance due to a difference in magnetic path length can be reduced.

Figure 3A:
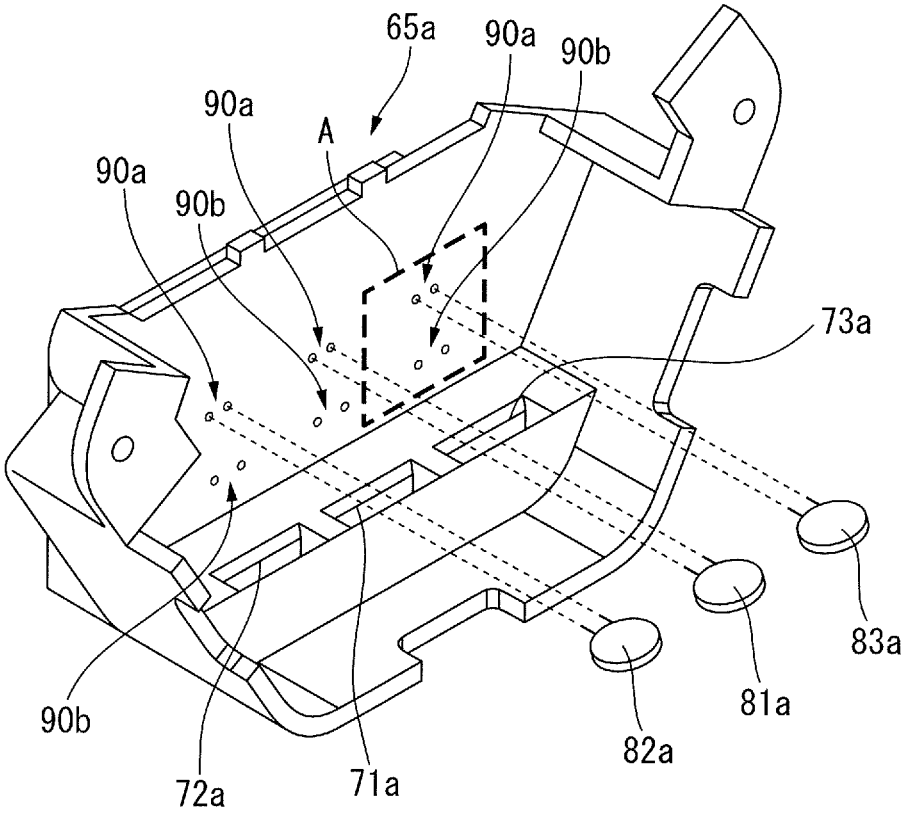
FIG. 3A is a first perspective view of one molded half portion of a terminal block.
Figure 3B:
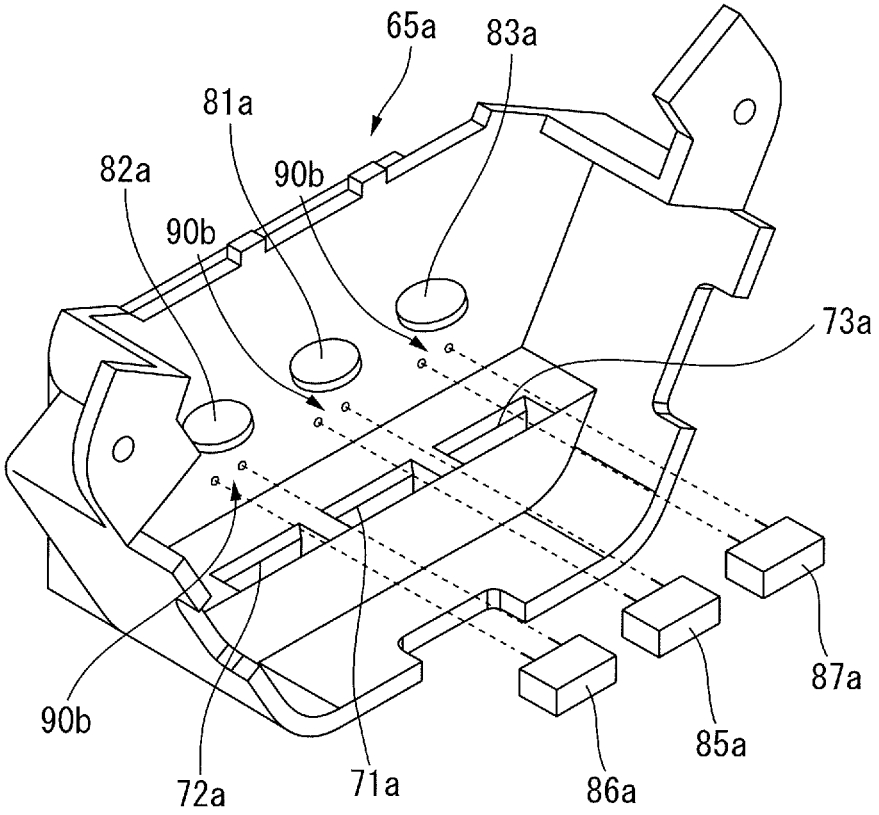
FIG. 3B is a second perspective view of one molded half portion of the terminal block.
Figure 3C:
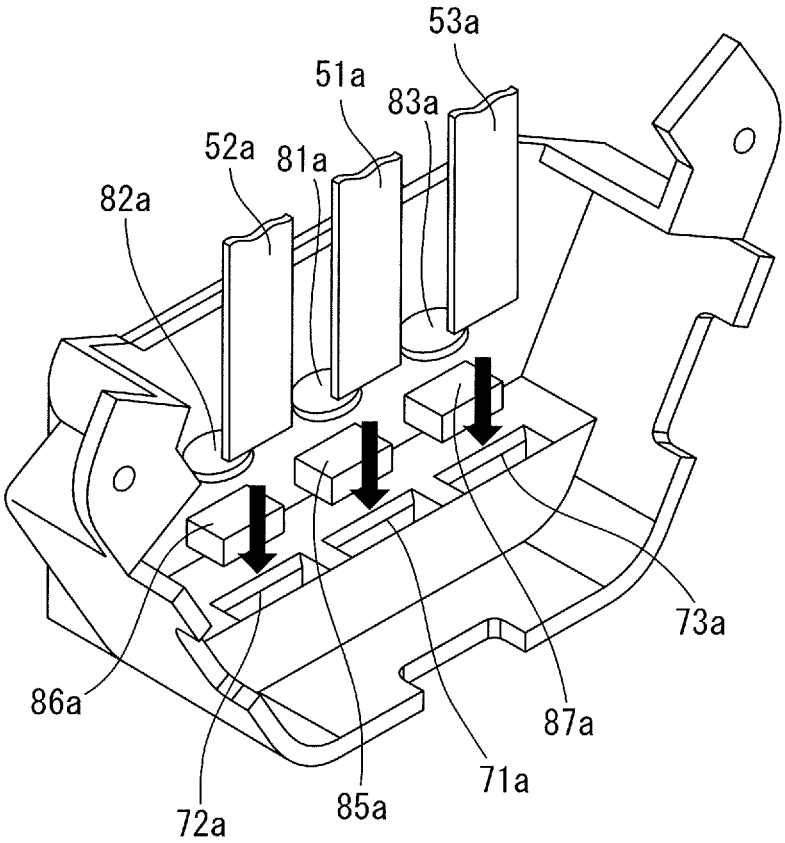
FIG. 3C is a third perspective view of one molded half portion of the terminal block.

FIG. 3A through FIG. 3C are perspective views of one of two molded half portions of a terminal block. Below, the one molded half portion 65*a* will be described. Since the configuration thereof is the same as the other molded half portion 65*b*, description of the molded half portion 65*b* has been omitted.

As shown in FIG. 3A and FIG. 1A, three pairs of through-holes 90*a* are formed in the top part of the molded half portion 65*a*. The three pairs of through-holes 90*a* are formed in a line parallel to the boundary between the molded half portion 65*a* and the molded half portion 65*b*. Further, another three pairs of through-holes 90*b* are formed between the terminals 71*a* to 73*a* and the three pairs of through-holes 90*a* in the same manner.

FIG. 3A shows three first surge protection elements 81*a* to 83*a*, for example, varistors. The leg parts of the three first surge protection elements 81*a* to 83*a* are inserted into the through-holes 90*a* and are electrically attached as described later by means of, for example, soldering.

Figure 4:
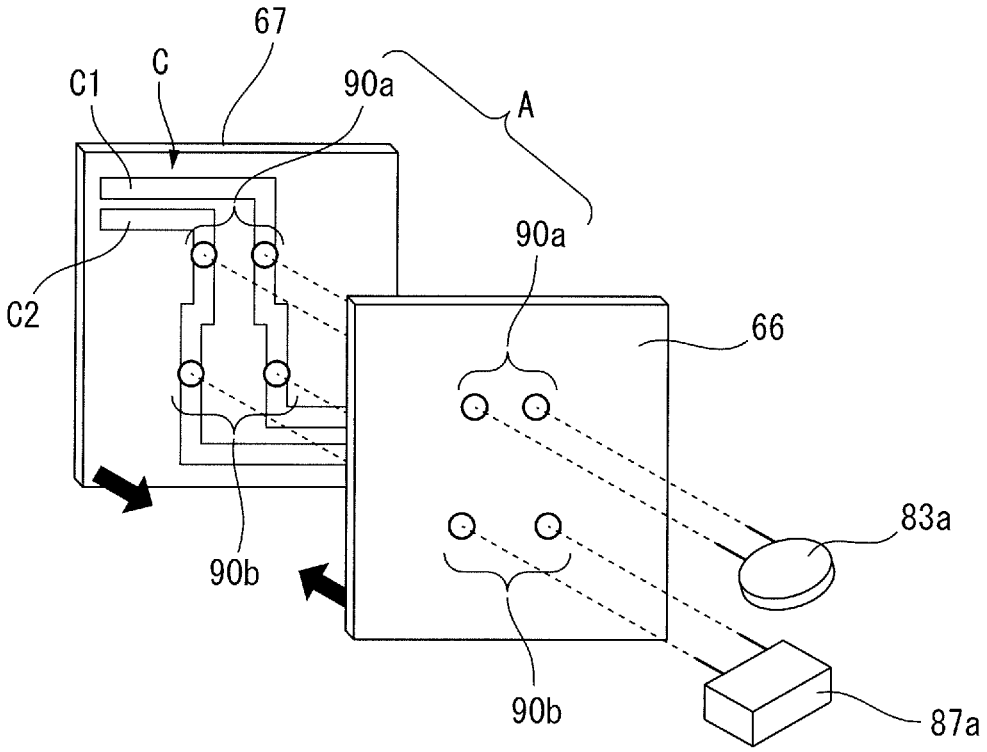
FIG. 4 is an enlarged perspective view showing one part of the wall part of the top part of the molded half portion.

FIG. 4 is an enlarged perspective view showing one part of the wall part of the top part of the molded half portion. The rectangular member A shown in FIG. 4 is one portion A of the wall part of the top part of the molded half portion 65*a* shown in FIG. 3A. The rectangular member A includes an inner wall part 66 defining the inner surface of the molded half portion 65*a* and an outer wall part 67 defining the outer surface of the molded half portion 65*a*. The inner wall part 66 and the outer wall part 67 are formed of a non-magnetic material, for example, a resin material. One pair of through-holes 90*a* and one pair of through-holes 90*b* are formed in the inner wall part 66 and the outer wall part 67.

The outer wall part 67 is a resin-molded circuit board 67 having a circuit C formed on one side thereof. The circuit C includes two short bars C1, C2 formed of a conductor. The short bars C1, C2 are electrically connected at one end to the corresponding terminal 73*a*. The other ends of the short bars C1, C2 extend in parallel in the area of the corresponding terminal 73*b* and terminate. As can be understood from FIG. 4, a pair of through-holes 90*a* and a pair of through-holes 90*b* are positioned in the short bars C1, C2. Note that the short bars C1, C2 having corresponding shapes may also be formed on one surface of the inner wall part 66 or the short bars C1, C2 may not be formed.

As shown in FIG. 4, the two leg parts of the first surge protection element 83*a* are inserted into one pair of through-holes 90*a* of the inner wall part 66 and the outer wall part 67 and are electrically attached to the outer surface of the outer wall part 67 by means of, for example, soldering. As a result, the first surge protection element 83*a* is electrically connected to the short bars C1, C2 so as to extend across the two short bars C1, C2. Likewise, the other first surge protection elements 81*a*, 82*a* are electrically connected to the other short bars C1, C2 in the regions of the corresponding terminals 71*a*, 72*a*.

Then, FIG. 3B shows three second surge protection elements 85*a* to 87*a*, for example, capacitors or surge absorbers. As shown in FIG. 3B, the leg parts of the second surge protection elements 85*a* to 87*a* are inserted into the three pairs of through-holes 90*b*, and as described with reference to FIG. 4, the second surge protection elements 85*a* to 87*a* are electrically connected to the short bars C1, C2.

The reason for using different types of first surge protection elements 81*a* to 83*a* and second surge protection elements 85*a* to 87*a* is to increase the effect of suppressing electrostatic discharge in various environments. However, only one type of surge protection element may be used. Then, the molded half portion 65*a* is brought close to and attached to the core body 5, which is not illustrated in FIG. 3C, and as a result, the input side extension portions 51*a* to 53*a* of the coils 51 to 53 are connected to the terminals 71*a* to 73*a* of the molded half portion 65*a*.

As can be understood from FIG. 3A through FIG. 3C, the first surge protection elements 81*a* to 83*a* and the second surge protection elements 85*a* to 87*a* are arranged on the inner wall of the molded half portion 65*a*. As shown in FIG. 1A, the molded half portion 65*a* includes a horizontal portion and a vertical portion, and the vertical cross-section of the molded half portion 65*a* is substantially L-shaped. The first surge protection elements 81*a* to 83*a* and the second surge protection elements 85*a* to 87*a* are arranged in a region in the vicinity of the region between the horizontal portion and the vertical portion. This region corresponds to the inside of the molded half portion 65*a*. Further, the outer wall 67 of the molded half portion 65*a* is a resin-molded circuit board including the short bars C1, C2.

Figure 5:
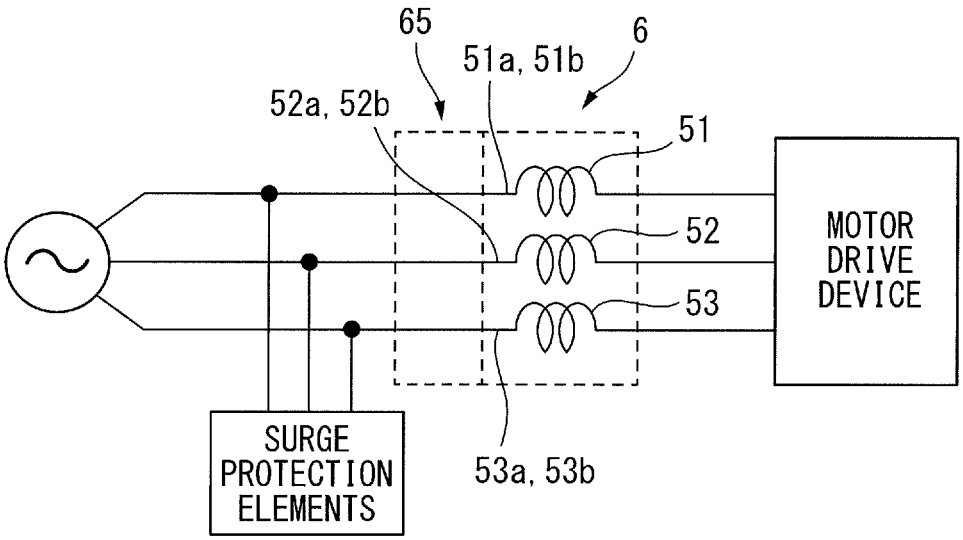
FIG. 5 is a circuit diagram including a reactor according to the prior art.

FIG. 5 is a circuit diagram including a reactor according to the prior art. In the prior art shown in FIG. 5, the surge protection equipment is arranged outside the reactor 6 and the terminal block 65. In other words, in the prior art, additional space is needed for the surge protection equipment.

Figure 6:
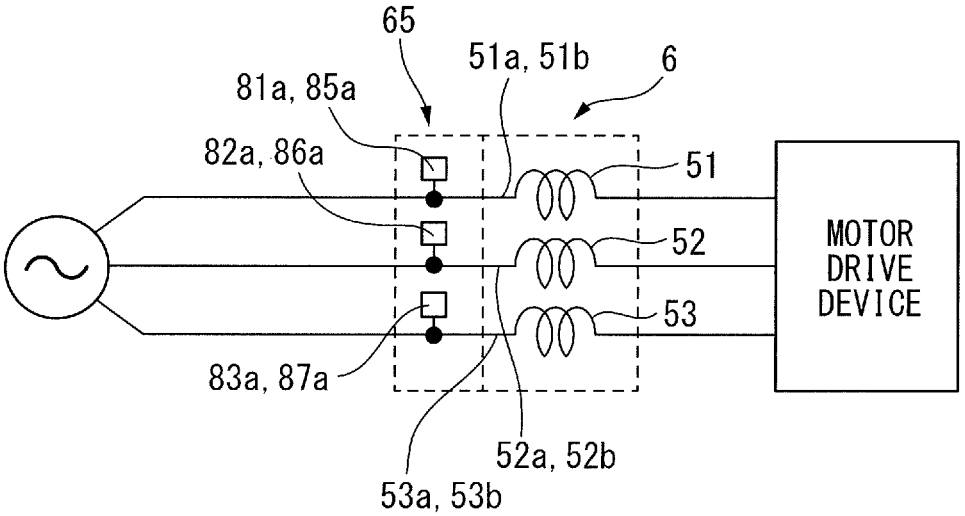
FIG. 6 is a circuit diagram including the reactor according to the first embodiment.

In contrast thereto, FIG. 6 is a circuit diagram including a reactor according to the first embodiment. In the configuration described above, the first surge protection elements 81*a* to 83*a* and the second surge protection elements 85*a* to 87*a* are arranged inside the terminal block 65 of the reactor 6. Thus, in the first embodiment, the first surge protection elements 81*a* to 83*a* and the second surge protection elements 85*a* to 87*a* can be attached to the terminal block 65 with minimal space.

Figure 7:
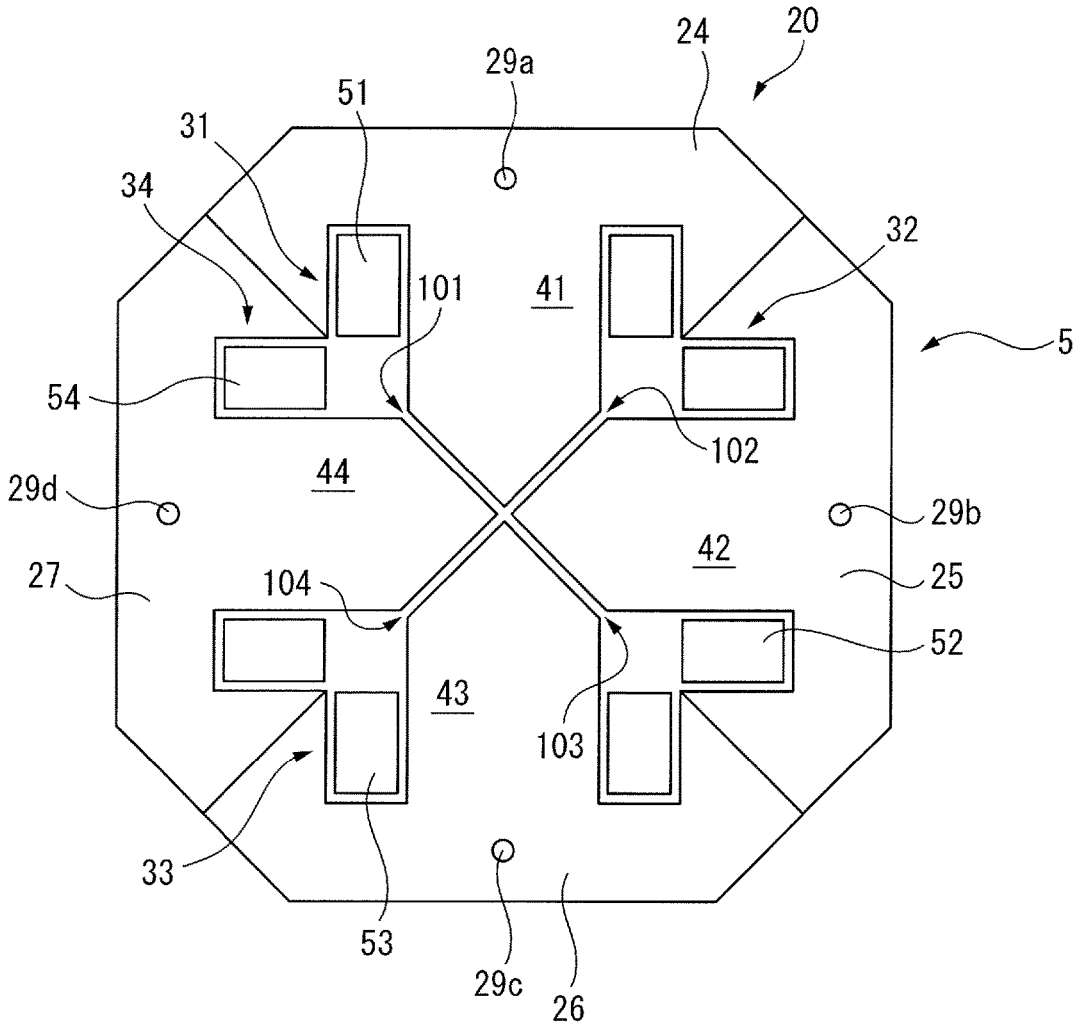
FIG. 7 is a cross-sectional view of a reactor according to a second embodiment.

Further, FIG. 7 is a cross-sectional view of a reactor according to a second embodiment. The core body 5 of the reactor 6 shown in FIG. 7 includes a substantially octagonal outer peripheral iron core 20 composed of a plurality of outer peripheral iron core portions 24 to 27 and four iron core coils 31 to 34, which are the same as the iron core coils described above, which contact with or are coupled to the inside surface of the outer peripheral iron core 20. The iron core coils 31 to 35 are arranged at equal intervals in the circumferential direction of the reactor 6. Furthermore, the number of the iron cores is preferably an even number not less than four, whereby the reactor 6 can be used as a single-phase reactor.

As can be understood from the drawing, the iron core coils 31 to 34 include iron cores 41 to 44 extending in the radial directions and coils 51 to 54 wound onto the respective iron cores, respectively. The radially outer ends of the iron cores 41 to 44 are in contact with the outer peripheral iron core 20 or are integrally formed with the outer peripheral iron core 20.

Further, each of the radially inner ends of the iron cores 41 to 44 is located near the center of the outer peripheral iron core 20. In FIG. 7, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, through which magnetic connection can be established.

In such a reactor 6, a terminal block (not shown) similar to that described above but having eight terminals 71*a* to 74*b* is prepared. The input side extension portions 51*a* to 54*a* and the output side extension portions 51*b* to 54*b* of the coils 51 to 54 are connected via the first surge protection elements 81*a* to 84*a* and the second surge protection elements 85*a* to 88*a* to the eight terminals 71*a* to 74*b* in the same manner as described above. Thus, it is can be understood that the same effects as described above can be obtained.

Aspects of the Disclosure

According to the first aspect, there is provided a reactor (6), comprising a core body (5), the core body comprising an outer peripheral iron core (20), at least three iron cores (41 to 44) which are arranged so as to contact or so as to be coupled with the inside of the outer peripheral iron core, and coils (51 to 54) wound onto the iron cores, wherein gaps (101 to 104), which can be magnetically coupled, are formed between one of the at least three iron cores and another iron core adjacent thereto, the reactor further comprising a terminal block (65) having a plurality of terminals (71*a* to 74*b*) and coupled to one end of the core body, and a plurality of surge protection elements (81*a* to 84*a* and 85*a* to 88*a*) which are connected to the plurality of terminals inside the terminal block, wherein input side extension portions (51*a* to 54*a*) and output side extension portions (51*b* to 54*b*) extending from the coils are connected to the respective terminals of the terminal block, and the plurality of surge protection elements are connected to the input side extension portions and the output side extension portions, respectively.

According to the second aspect, in the first aspect, each of the plurality of surge protection elements includes at least one of a capacitor, a varistor, and a surge absorber.

According to the third aspect, in the first or second aspect, each of the plurality of surge protection elements are connected to the terminals via a resin-molded circuit board (67) which forms a part of a wall portion of the terminal block.

According to the fourth aspect, in any of the first through third aspects, the number of the at least three iron cores is a multiple of three.

According to the fifth aspect, in any of the first through third aspect, the number of the at least three iron cores is an even number not less than four.

Effects of the Aspects

In the first aspect, since the plurality of surge protection elements are arranged inside the terminal block, the reactor can have a surge protection function in a minimal space.

In the second aspect, the electrostatic discharge suppression effect can be improved in various environments.

In the third aspect, since the resin-molded circuit board is used, it is possible to further reduce the space required to install the surge protection elements.

In the fourth aspect, the reactor can be used as a three-phase reactor.

In the fifth aspect, the reactor can be used as a single-phase reactor.

Though the present invention has been described using representative embodiments, a person skilled in the art would understand that the foregoing modifications and various other modifications, omissions, and additions can be made without departing from the scope of the present invention.

The invention claimed is:

1. A reactor, comprising:

a core body, the core body comprising:

an outer peripheral iron core, at least three iron cores which are arranged so as to contact or so as to be coupled with the inside of the outer peripheral iron core, and coils wound onto the iron cores, wherein gaps, which can be magnetically coupled, are formed between one of the at least three iron cores and another iron core adjacent thereto, the reactor further comprising:

a terminal block having a plurality of terminals and coupled to one end of the core body, and a plurality of surge protection elements which are connected to the plurality of terminals inside the terminal block, wherein input side extension portions and output side extension portions extending from the coils are connected to the respective terminals of the terminal block, and the plurality of surge protection elements are connected to the input side extension portions and the output side extension portions, respectively.

2. The reactor according to claim 1, wherein each of the plurality of surge protection elements includes at least one of a capacitor, a varistor, and a surge absorber.

3. The reactor according to claim 1, wherein the each of plurality of surge protection elements are connected to the terminals via a resin-molded circuit board which forms a part of a wall portion of the terminal block.

4. The reactor according to claim 1, wherein the number of the at least three iron cores is a multiple of three.

5. The reactor according to claim 1, wherein the number of the at least three iron cores is an even number not less than four.

* * * * *